US007866407B2

(12) United States Patent
San Martin et al.

(10) Patent No.: US 7,866,407 B2
(45) **Date of Patent: *Jan. 11, 2011**

(54) METHOD FOR CONSTRUCTION OF LOW THERMAL EXPANSION AND LOW RESISTANCE WIRE FOR LOGGING APPLICATIONS

(75) Inventors: Luis E. San Martin, Houston, TX (US); Evan L. Davies, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 63 days.

This patent is subject to a terminal disclaimer.

(21) Appl. No.: 11/716,998

(22) Filed: Mar. 12, 2007

(65) Prior Publication Data

US 2008/0035352 A1 Feb. 14, 2008

Related U.S. Application Data

(63) Continuation of application No. 10/739,550, filed on Dec. 18, 2003, now Pat. No. 7,195,075.

(51) Int. Cl.
*E21B 19/084* (2006.01)
*H01B 1/02* (2006.01)

(52) U.S. Cl. ..... 166/385; 166/65.1; 166/242.2; 175/57; 175/90

(58) Field of Classification Search ..... None
See application file for complete search history.

(56) References Cited

U.S. PATENT DOCUMENTS

| | | | | |
|---|---|---|---|---|
| 3,909,555 | A | 9/1975 | Harris | |
| 4,944,570 | A * | 7/1990 | Oglesby et al. | 385/101 |
| 5,892,176 | A | 4/1999 | Findlay et al. | |
| 7,195,075 | B2 | 3/2007 | Martin et al. | |

OTHER PUBLICATIONS

Table of Resistivities, www.wikipedia.org , undated.*
Thermal expansion coefficients for some common materials, www.wikipedia.org , undated.*
"U.S. Appl. No. 10/739,550, Non Final Office Action mailed Mar. 9, 2006", 6 pgs.
"U.S. Appl. No. 10/739,550, Non Final Office Action mailed Jul. 6, 2006", 6 pgs.
"U.S. Appl. No. 10/739,550, Notice of Allowance mailed Nov. 13, 2006", 6 pgs.
"U.S. Appl. No. 10/739,550, Response filed Apr. 20, 2006 to Non Final Office Action mailed Mar. 9, 2006", 20 pgs.
"U.S. Appl. No. 10/739,550, Response filed Aug. 15, 2006 to Non Final Office Action mailed Jul. 6, 2006", 22 pgs.

* cited by examiner

*Primary Examiner*—Zakiya W. Bates
(74) *Attorney, Agent, or Firm*—Schwegman, Lundberg & Woessner, P.A.

(57) ABSTRACT

A device is provided, the device comprising a downhole tool comprising a wire comprising at least one strand comprising a low thermal expansion material. The low thermal expansion material may have a low electrical resistance material disposed thereon.

23 Claims, 7 Drawing Sheets

METHOD FOR CONSTRUCTION OF LOW THERMAL EXPANSION AND LOW RESISTANCE WIRE FOR LOGGING APPLICATIONS

PRIORITY Of INVENTION

This application is a continuation application of U.S. patent application Ser. No. 10/739,550, filed Dec. 18, 2003, now U.S. Pat. No. 7,195,075, which is herein incorporated by reference.

BACKGROUND OF THE INVENTION

1. Field of the Invention

This invention relates generally to a method and apparatus useful in the exploration of subterranean regions and, more particularly, to a method and apparatus useful in the exploration for, and production of, hydrocarbons from subterranean regions. In various aspects, the present invention relates to a method and apparatus for a new type of wire that combines high conductivity and low thermal expansion that can be used to reduce temperature sensitivity effects in induction logging tools and other instruments that require wires with low thermal expansion and low electrical resistance.

2. Description of the Related Art

As shown in FIG. 1, a conventional drilling and/or logging operation is shown, including a drilling and/or logging rig 120 and a downhole induction logging tool 100. The drilling and/or logging rig 120 is generally a rotary drilling and/or logging rig of the type that is well known in the drilling and/or logging art and comprises a mast 122 that rises above the ground 124. The rotary drilling and/or logging rig 120 is fitted with lifting gear (not shown) from which is suspended a drill and/or logging string 126 formed by a multiplicity of drill pipes 128 screwed into one another, and/or a logging wire or cable (not shown), where the drill and/or logging string 126 may have at its lower downhole end a drill bit 132 for the purpose of drilling a well bore 134. The downhole induction logging tool 100 may be located in the drill and/or logging string 126 in any suitable location and by any suitable manner known to those in the relevant art.

Induction tool measurements used in logging applications, made by the downhole induction logging tool 100, for example, are very sensitive to changes in the position and/or the diameter of either or both the receiver and/or the transmitter coils. The dimensions of all the parts of an induction tool should be as invariant as possible even as the temperature of the induction tool varies over a wide range from typical surface temperatures of about 68° F. (20° C.), or lower (subzero surface temperatures could be experienced, for example, during testing and calibration in Alaska, for example), to downhole temperatures of about 500° F. (260° C.), or higher (generally, the deeper the well, the higher the downhole temperature), in the deeper wells. Low thermal expansion materials have typically been used, such as low thermal expansion ceramics, for example, silicon nitride ($Si_2N_3$).

The wire in the coils of the induction tools are typically made of thin copper (Cu) filaments. Copper (Cu) is selected for its low electrical resistance (high electrical conductivity). However, copper (Cu) is less than optimal for these induction tool applications due to its relatively high thermal expansion. The effect of the thermal expansion of copper (Cu) can produce significant changes in the signals measured, particularly in the shallower induction measurements that are associated with shorter receiver-transmitter spacings.

As shown in FIGS. 2 and 3, a type of wire conventionally used in downhole induction tools is a litz wire 200 made up of many fine, and separately insulated, strands 210 of copper (Cu) that are woven together, typically so that each of the strands 210 successively takes up all possible positions in the cross-section of the litz wire 200. FIG. 2 shows a side view of the litz wire 200. FIG. 3 shows a cross-sectional view of the litz wire 200.

The purpose of the strands 210 is to provide the maximum surface area for a given cross-section of the litz wire 200. At the typical frequencies used in downhole induction tools, in a range from about 8 kHz to about 200 kHz, the electrical current flows in a thin layer at or near the surface of each of the strands 210 of the litz wire 200. By using several strands 210, the overall resistance of the litz wire 200 is reduced at these typical frequencies. However, if no method to reduce the thermal expansion of the litz wire 200 is used, the thermal expansion of the litz wire 200 with increased temperature produces changes in the signal level of the downhole induction tool 100 that are tolerable for receiver-transmitter induction coil spacings greater than about 20 inches (50 cm), but that are not tolerable for receiver-transmitter induction coil spacings less than about 20 inches (50 cm). For receiver-transmitter induction coil spacings less than about 20 inches (50 cm), the effect of the thermal expansion of the litz wire 200 with increased temperature is very significant, producing intolerable changes in the signal level of the downhole induction tool 100, making the achievement of more stable measurements much more difficult.

The present invention is directed to overcoming, or at least reducing the effects of, one or more of the problems set forth above.

SUMMARY OF THE INVENTION

In one aspect of the present invention, a device is provided, the device comprising a downhole tool comprising a wire comprising at least one strand comprising a low thermal expansion material. The low thermal expansion material may have a low electrical resistance material disposed thereon.

In another aspect of the present invention, a device is provided, the device comprising a downhole tool comprising a wire comprising a plurality of strands, each of the plurality of the strands comprising a low thermal expansion material. The low thermal expansion material has a low electrical resistance material disposed thereon.

In yet another aspect of the present invention, a device is provided, the device comprising a downhole tool comprising a wire comprising first strands in a central portion of the wire, the first strands comprising a low thermal expansion material. The device also comprises the wire comprising second strands in a peripheral portion of the wire, the second strands comprising a low electrical resistance material.

In still yet another aspect of the present invention, a method is provided, the method comprising providing a wire comprising at least one strand for use in a downhole tool, the at least one strand comprising a low thermal expansion material. The low thermal expansion material may have a low electrical resistance material disposed thereon.

In another aspect of the present invention, a method is provided, the method comprising providing a wire comprising a plurality of strands for use in a downhole tool, each of the plurality of the strands comprising a low thermal expansion material. The low thermal expansion material has a low electrical resistance material disposed thereon.

In still another aspect of the present invention, a method is provided, the method comprising providing a wire for use in a downhole tool, the wire comprising first strands in a central portion of the wire, the first strands comprising a low thermal expansion material. The method also comprises providing the wire comprising second strands in a peripheral portion of the wire, the second strands comprising a low electrical resistance material.

In yet another aspect of the present invention, a device is provided, the device comprising a wire comprising at least one strand for use in a downhole tool, the at least one strand comprising means for decreasing thermal expansion of the wire. The at least one strand also comprises means for decreasing electrical resistance of the wire disposed on the means for decreasing thermal expansion of the wire.

In still yet another aspect of the present invention, a device is provided, the device comprising a wire comprising a plurality of strands for use in a downhole tool, each of the plurality of the strands comprising means for decreasing thermal expansion of the wire. Each of the plurality of the strands also comprises means for decreasing electrical resistance of the wire disposed on the means for decreasing thermal expansion of the wire.

In another aspect of the present invention, a device is provided, the device comprising a wire for use in a downhole tool, the wire comprising first strands in a central portion of the wire, the first strands comprising means for decreasing thermal expansion of the wire. The device also comprises the wire comprising second strands in a peripheral portion of the wire, the second strands comprising means for decreasing electrical resistance of the wire.

It is an object of the present invention to provide a method and apparatus to reduce the thermal expansion of wire, such as the wire used in one or more coils in a downhole induction tool, while preserving the low resistance of the wire. It is another object of the present invention to provide a method and apparatus to combine high conductivity and low thermal expansion of wire used for downhole induction tool applications. It is yet another object of the present invention to reduce temperature effects in downhole induction logging tools and in other instruments that require a wire with low thermal expansion and low electrical resistance.

These and other objects of the present invention will become apparent to those of skill in the art upon review of the present specification, including the drawings and the claims.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which:

FIG. 4 schematically illustrates various exemplary embodiments of a strand according to the present invention;

FIGS. 5-8 schematically illustrate various further exemplary embodiments of wires comprising strands according to the present invention;

FIG. 9 schematically illustrates an exemplary embodiment of a method 900 practiced in accordance with the present invention;

FIG. 10 schematically illustrates an exemplary embodiment of a method 1000 practiced in accordance with the present invention; and FIG. 11 schematically illustrates an exemplary embodiment of a method 1100 practiced in accordance with the present invention.

Figure 1:
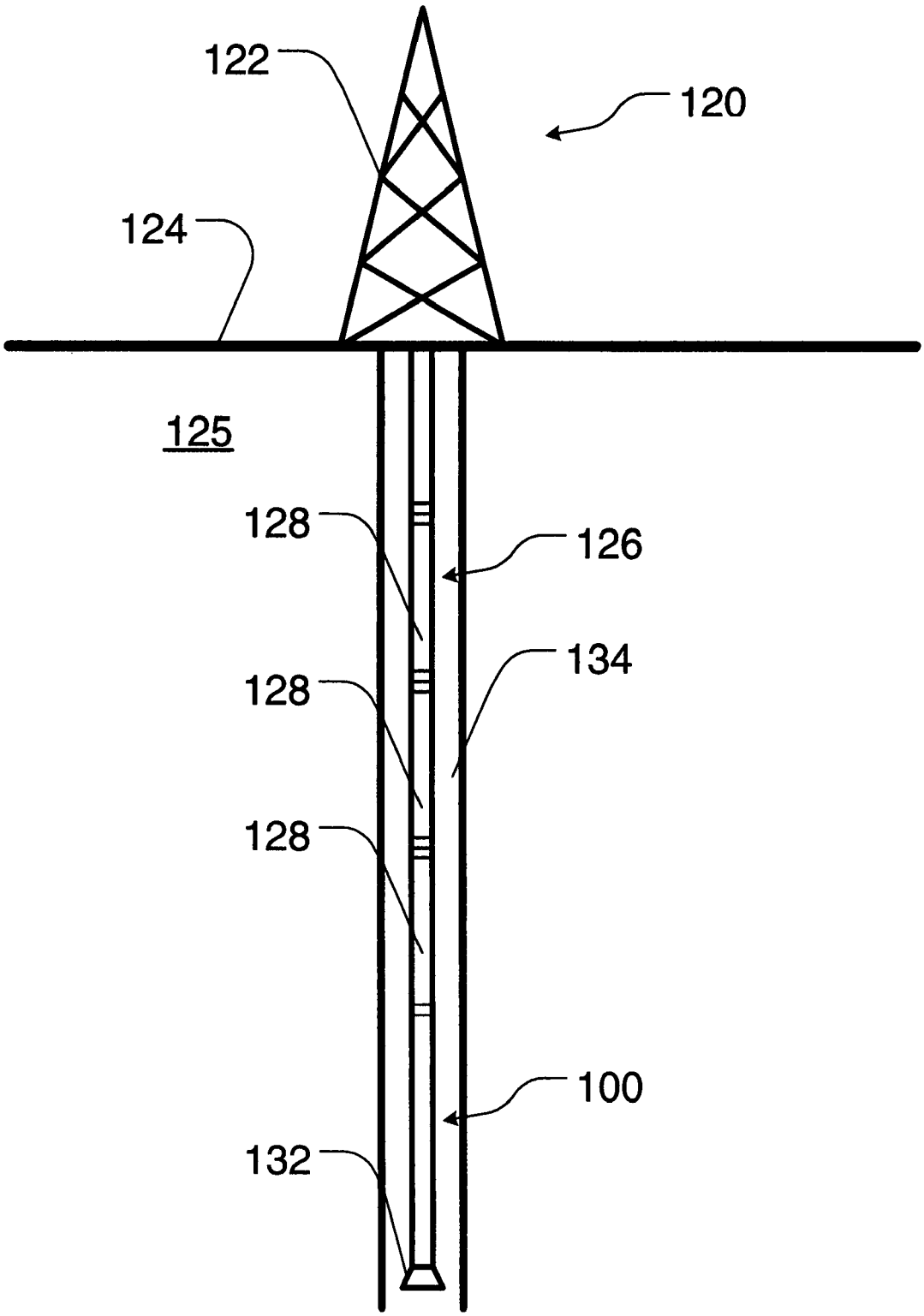
Figure 1 (Prior Art)
FIG. 1 schematically illustrates a conventional drilling and/or logging operation showing a drilling and/or logging rig 120 and a downhole induction logging tool 100.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 4:
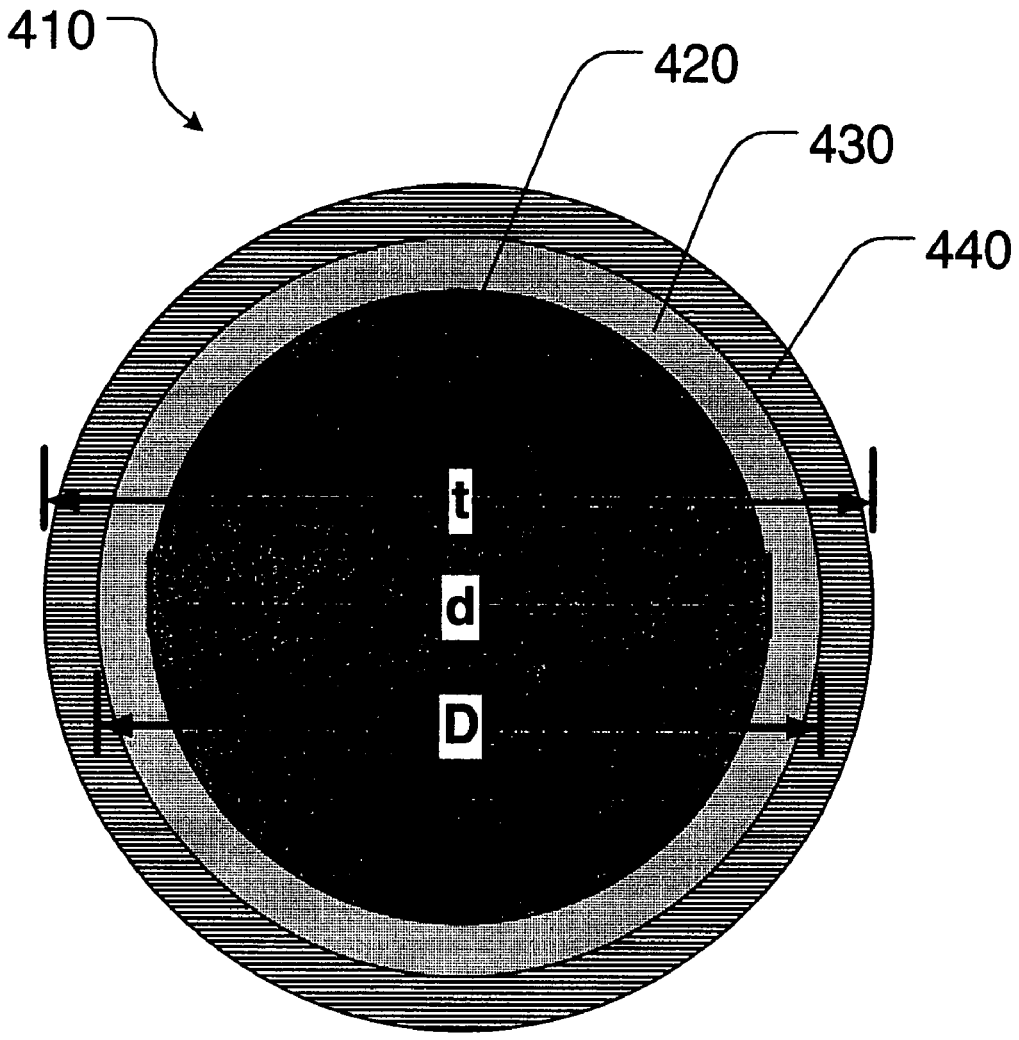
FIGS. 4-11 schematically illustrate various embodiments of a method and a device according to the present invention.

Illustrative embodiments of a method and a device according to the present invention are shown in FIGS. 4-11. As shown in FIG. 4, a strand 410 may be used by itself as the wire wrapped around a ceramic mandrel for a coil used in a downhole induction logging tool. The strand 410 may comprise a low thermal expansion material 420 (with a diameter d) having a low electrical resistance material 430 (with an outer diameter D) disposed on the low thermal expansion material 420.

In various illustrative embodiments, the downhole tool may include a downhole drilling tool, a downhole sensor tool, such as the downhole induction logging tool described herein, a downhole transformer, a downhole electrical motor, a downhole antenna, a downhole receiver, a downhole transmitter, a downhole acoustic device, and the like.

In various alternative illustrative embodiments, the strand 410 may comprise only the low thermal expansion material 420 (with a diameter d), without having any low electrical resistance material 430 disposed on the low thermal expansion material 420. For example, in these various alternative illustrative embodiments, the low thermal expansion material 420 may comprise only molybdenum (Mo). In various other alternative illustrative embodiments, the strand 410 may comprise substantially only the low thermal expansion material 420 (with the diameter d), having a very thin layer of a low electrical resistance material 430 (with the outer diameter D only slightly larger than the diameter d) disposed on the low thermal expansion material 420. For example, in these various other alternative illustrative embodiments, the very thin layer of the low electrical resistance material 430 may be such that the difference D-d between the outer diameter D (of the low electrical resistance material 430) and the diameter d may be in a range from about 1 micron to about 200 microns, so that the low electrical resistance material 430 may have a thickness in a range from about 0.5 micron to about 100 microns. For example, in these various other alternative illustrative embodiments, the low thermal expansion material 420 may comprise substantially only molybdenum (Mo), having a very thin "flash protection" layer of about 15 microns of gold (Au) disposed on the molybdenum (Mo), also helping the molybdenum (Mo) to be more corrosion-resistant at elevated downhole temperatures.

In various illustrative embodiments, the ratio of the diameter d (of the low thermal expansion material 420) to the difference D-d between the outer diameter D (of the low electrical resistance material 430) and the diameter d may be in a range from about 1000 to 1 to about 2 to 1, or, more precisely, an optimal amount of low electrical resistance material and low thermal expansion material, for a specific application that considers temperature range and conductivity requirements, could be derived from equations that describe thermal expansion and mechanical equilibrium of the materials, and considerations about the bonding strength between the materials and the properties of the insulating coating. In particular, the ratio of the diameter d to the difference D-d may be about 3 to 1. The ratio of the diameter d to the difference D-d may determine the overall resistance of the strand 410. As shown in FIG. 4, the strand 410 may further comprise an insulating material 440 (with an outer diameter t) disposed on the low electrical resistance material 430. In various alternative illustrative embodiments, as described above, in which the strand 410 may comprise only the low thermal expansion material 420 (with a diameter d), without having any low electrical resistance material 430 disposed on the low thermal expansion material 420, the strand 410 may further comprise the insulating material 440 (with an outer diameter t) disposed directly on the low thermal expansion material 420 (not shown).

In various illustrative embodiments, the low thermal expansion material 420 may have a thermal expansion coefficient lower than the thermal expansion coefficient of copper (Cu). For example, the low thermal expansion material 420 may comprise graphite (C), chromium (Cr), iridium (Ir), molybdenum (Mo), niobium (Nb), osmium (Os), rhodium (Rh), tantalum (Ta), titanium (Ti), tungsten (W), and vanadium (V), and/or any alloys thereof, and/or alloys such as Invar (a Fe—Ni alloy), Kovar (a Fe—Ni—Co alloy), and the like. In particular, the low thermal expansion material 420 may comprise molybdenum (Mo). For example, molybdenum (Mo) has a thermal expansion coefficient lower than the thermal expansion coefficient of copper (Cu) by a factor of about 3.2, and a conductivity (reciprocal of resistivity) about one-third the conductivity of copper (Cu).

In various illustrative embodiments, the low electrical resistance material 430 may have an electrical resistance lower than the electrical resistance of the low thermal expansion material 420. For example, the low electrical resistance material 430 may comprise aluminum (Al), copper (Cu), gold (Au), and silver (Ag), and/or any alloys thereof. In particular, the low electrical resistance material 430 may comprise copper (Cu). Having the low electrical resistance material 430 comprise copper (Cu) may increase the solderability of the strand 410. Having the low electrical resistance material 430 comprise copper (Cu) may also lower and/or reduce the series resistance of a wire comprising the strands 410.

In various illustrative embodiments, the insulating material 440 may comprise glass fiber, polyester, teflon®, polyimide, and the like. In particular, the insulating material 440 may comprise polyimide-ML, which is particularly useful for high temperatures in excess of about 392° F. (200° C.). The insulating material 440 provides electrical isolation between the strands 410.

Figure 2:
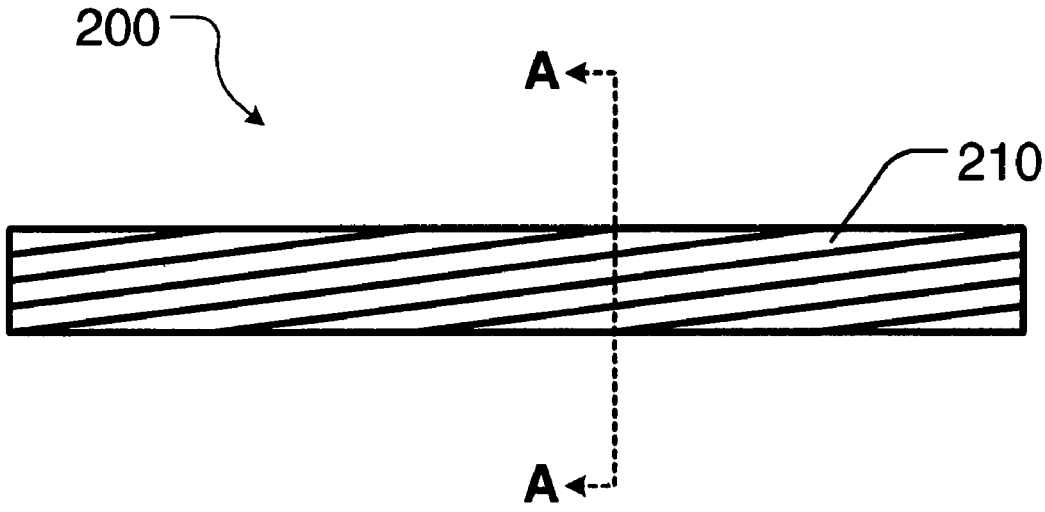
Figure 2 (Prior Art)
FIGS. 2 and 3 schematically illustrate side and cross-sectional views, respectively, of a conventional all-copper (Cu) litz wire consisting of woven strands all made of copper (Cu)
Figure 3:
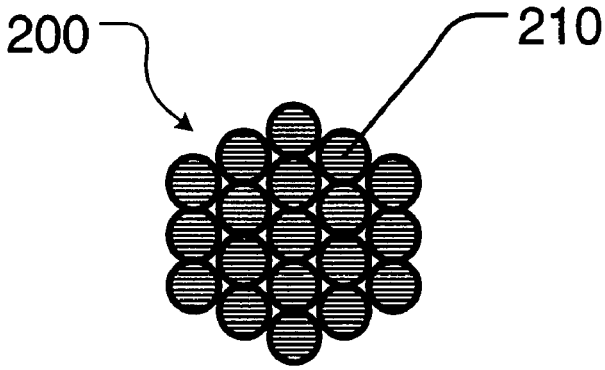
Figure 3 (Prior Art)
Figure 5:
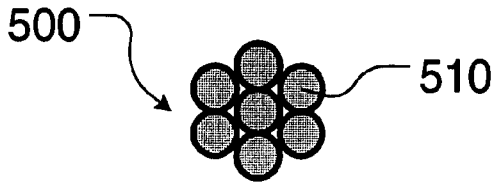
Figure 6:
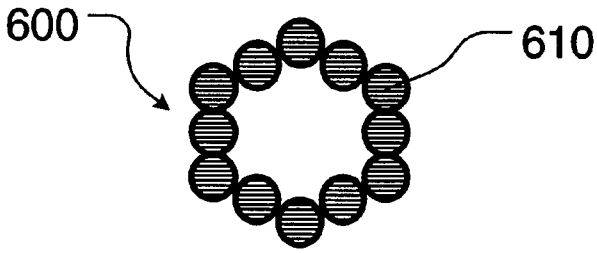
Figure 7:
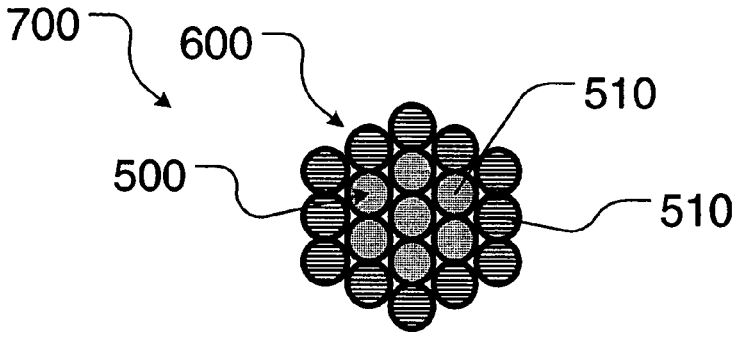

In various illustrative embodiments, as shown in FIGS. 5 and 7, each of a plurality of strands 510 included in a central portion 500 of a wire 700 (FIG. 7) may be like the strand 410, as shown in FIG. 4, comprising the low thermal expansion material 420 (with the diameter d) having the low electrical resistance material 430 (with the outer diameter D) disposed on the low thermal expansion material 420. Similarly, in various illustrative embodiments, as shown in FIGS. 6 and 7, each of a plurality of strands 610 included in a peripheral portion 600 of the wire 700 (FIG. 7) may be like the strand 210, as shown in FIG. 2, comprising a low electrical resistance material, such as copper (Cu).

In various illustrative embodiments, as shown in FIG. 7, the wire 700 may comprise the strands 510 (comprising the central portion 500 of the wire 700) together with the strands 610 (comprising the peripheral portion 600 of the wire 700). The shorter strands 510 in the central portion 500 of the wire 700 control the mechanical expansion properties of the wire 700 such as the overall axial expansion (i.e., the overall lengthening) of the wire 700. When woven in this manner, the thermal expansion of the wire 700 is controlled mostly by the low thermal expansion strands 510. In various alternative illustrative embodiments, the low electrical resistance strands 610 may be interwoven with the low thermal expansion strands 510. As the temperature increases, the low electrical resistance strands 610 expand faster than the low thermal expansion strands 510, increasing the thickness of the wire 700, but the overall axial length of the wire 700 (and thereby the diameter of the coils of the downhole inductive tools formed therefrom) is controlled by the low thermal expansion strands 510.

Figure 8:
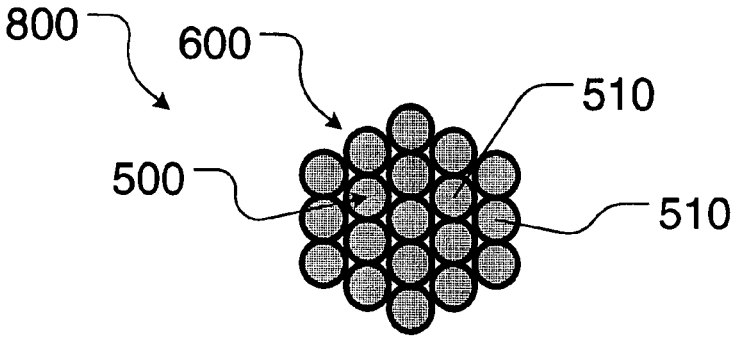

In various illustrative embodiments, as shown in FIG. 8, a wire 800 may comprise only the strands 510 woven together. When woven in this manner, the thermal expansion of the wire 700 is entirely controlled by the low thermal expansion strands 510.

Figure 9:
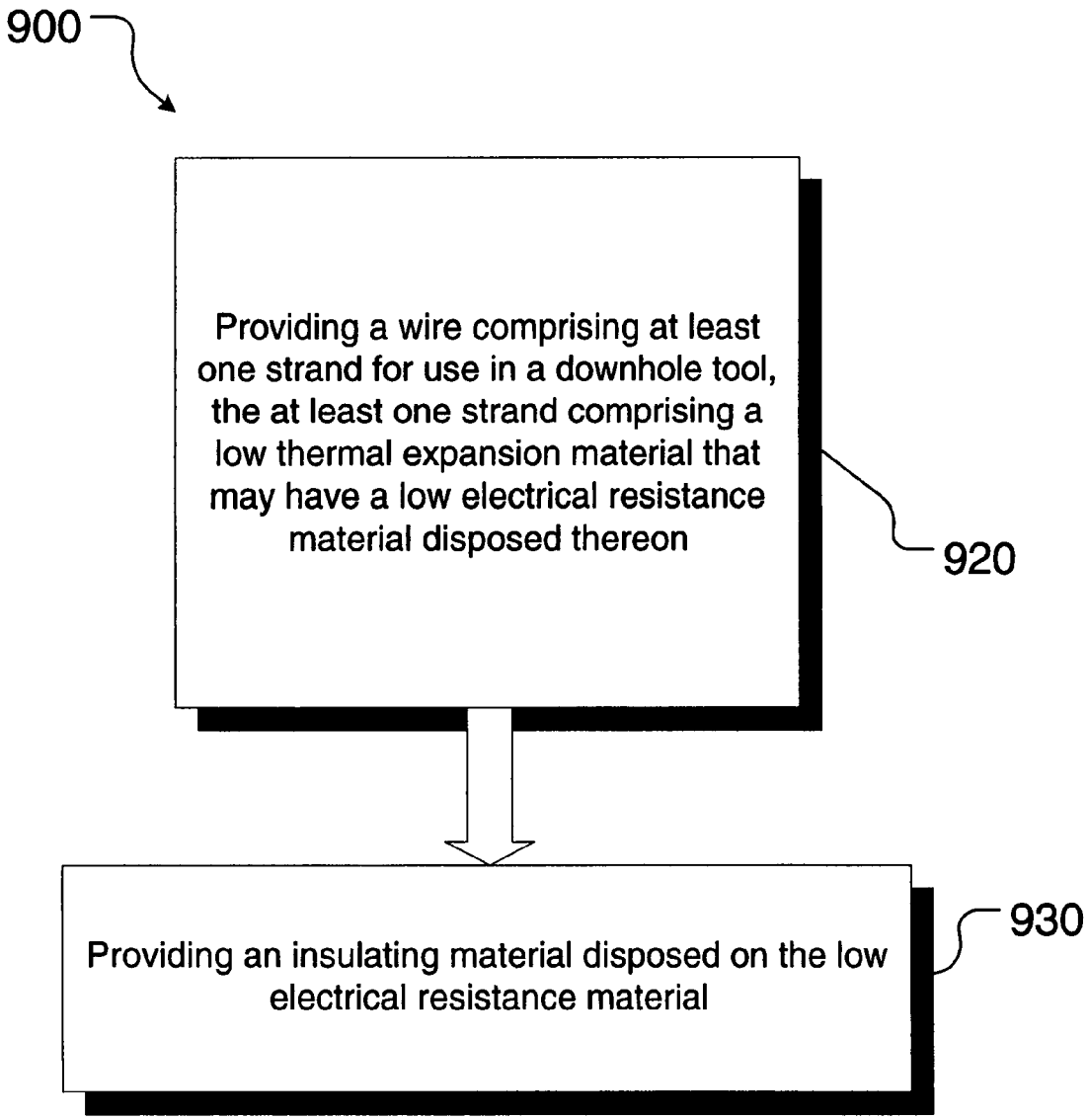
Figure 10:
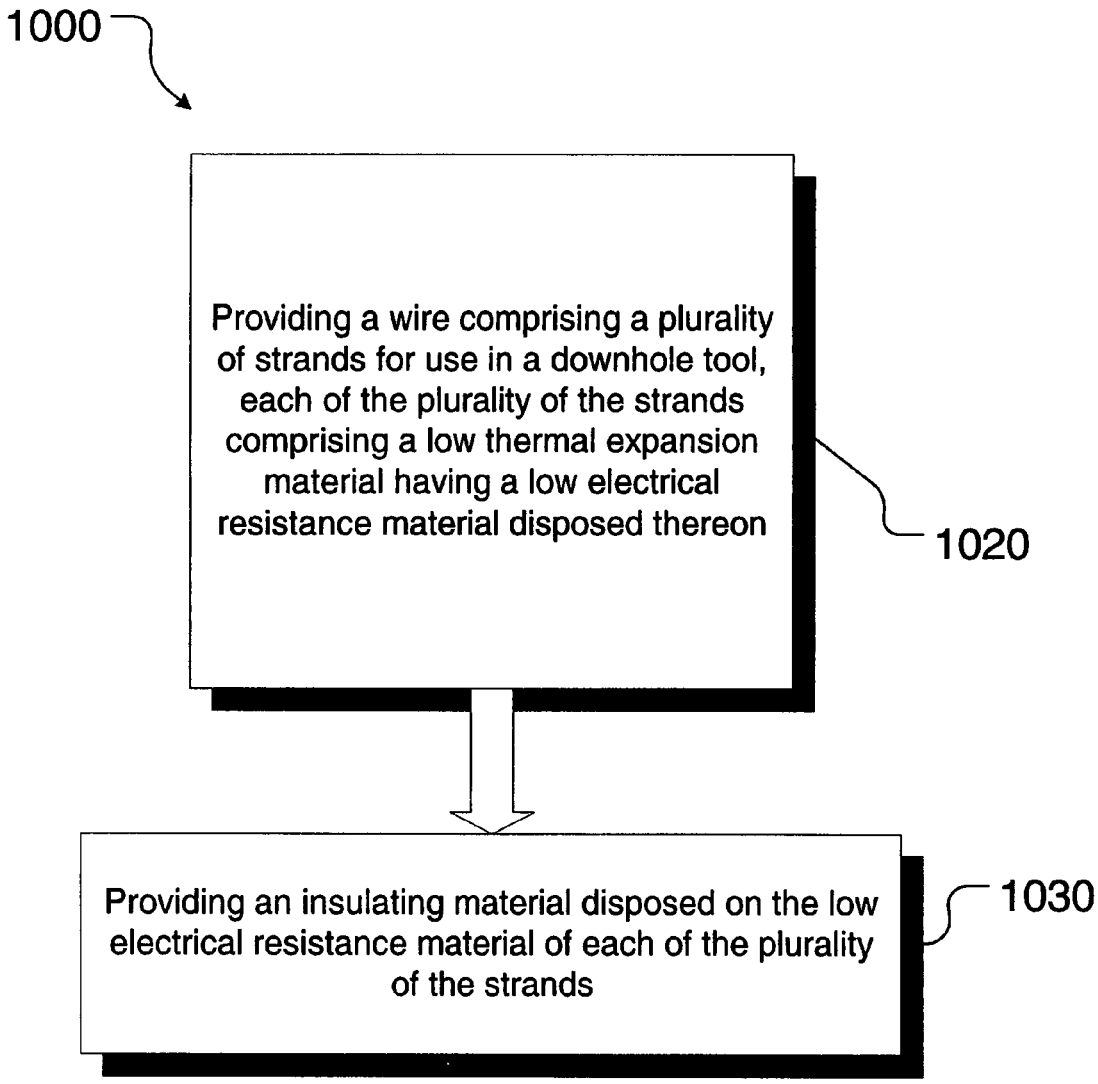
Figure 11:
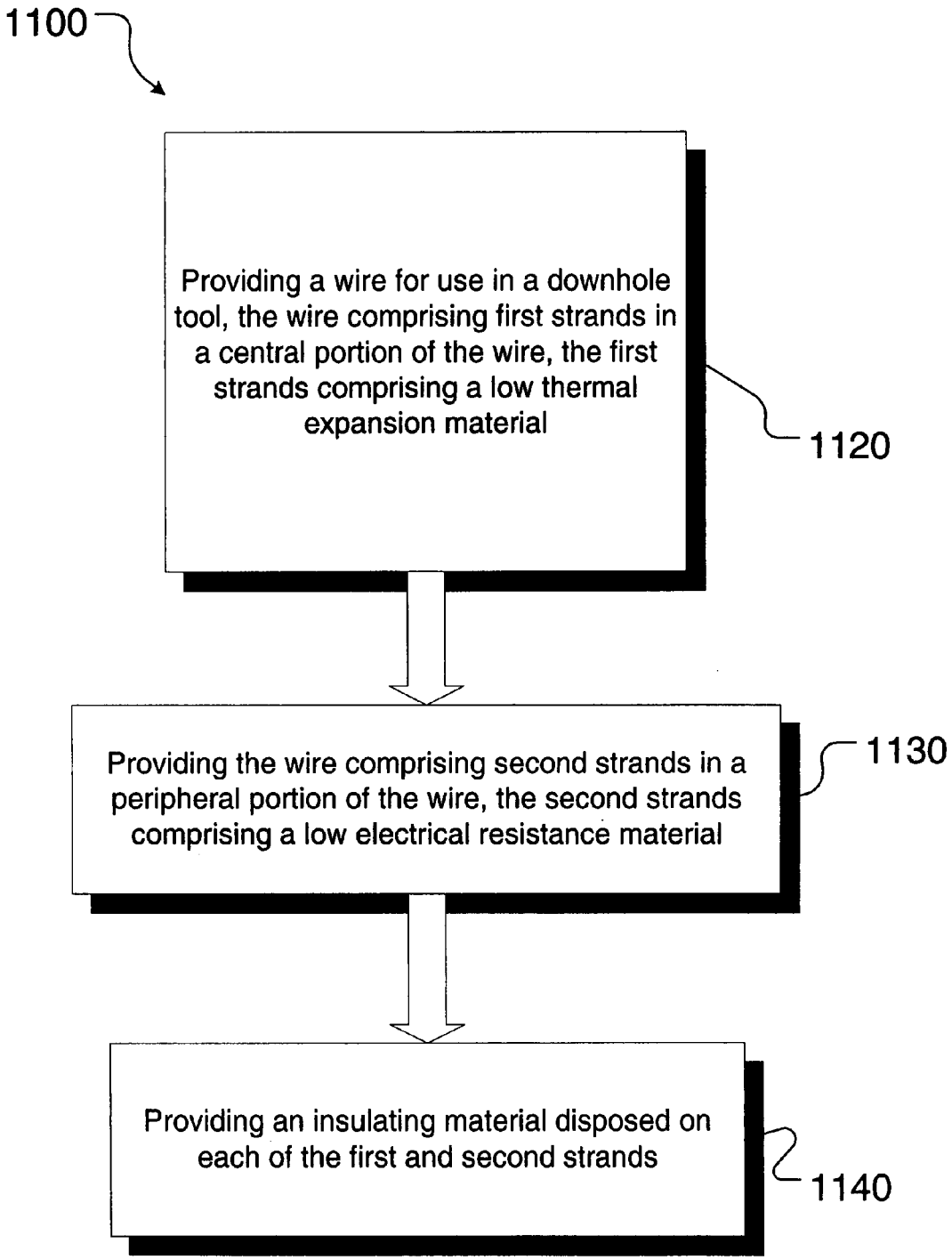

FIGS. 9-11 schematically illustrate particular embodiments of respective methods 900-1100 practiced in accordance with the present invention. FIGS. 4-8 schematically illustrate various exemplary particular embodiments with which the methods 900-1100 may be practiced. For the sake of clarity, and to further an understanding of the invention, the methods 900-1100 shall be disclosed in the context of the various exemplary particular embodiments shown in FIGS. 4-8. However, the present invention is not so limited and admits wide variation, as is discussed further below.

In various illustrative embodiments, as shown in FIG. 9, the method 900 begins, as set forth in box 920, by providing a wire comprising at least one strand for use in a downhole tool, the at least one strand comprising a low thermal expansion material that may have a low electrical resistance material disposed thereon. For example, the strand 410, as shown in FIG. 4, may be used by itself as the wire wrapped around a ceramic mandrel for a coil used in a downhole induction logging tool. The strand 410 may comprise the low thermal expansion material 420 (with the diameter d) that may have the low electrical resistance material 430 (with the outer diameter D) disposed on the low thermal expansion material 420.

In various illustrative embodiments, as shown in FIG. 9, the method 900 may proceed by providing an insulating material disposed on the low electrical resistance material, as set forth in box 930. For example, as shown in FIG. 4, the strand 410 may further comprise the insulating material 440 (with the outer diameter t) disposed on the low electrical resistance material 430, as described above.

In various illustrative embodiments, as shown in FIG. 10, the method 1000 begins, as set forth in box 1020, by providing a wire comprising a plurality of strands for use in a downhole tool, each of the plurality of the strands comprising a low thermal expansion material having a low electrical resistance material disposed thereon. For example, the wire 800, as shown in FIG. 8, may be used as the wire wrapped around a ceramic mandrel for a coil used in a downhole induction logging tool. Each of the plurality of the strands 510 included in the wire 800 may be like the strand 410, as shown in FIG. 4, comprising the low thermal expansion material 420 (with the diameter d) having the low electrical resistance material 430 (with the outer diameter D) disposed on the low thermal expansion material 420.

As shown in FIG. 10, the method 1000 may proceed by providing an insulating material disposed on the low electrical resistance material of each of the plurality of the strands, as set forth in box 1030. For example, each of the plurality of the strands 510 included in the wire 800 may be like the strand 410, as shown in FIG. 4, further comprising the insulating material 440 (with the outer diameter t) disposed on the low electrical resistance material 430, as described above.

In various illustrative embodiments, as shown in FIG. 11, the method 1100 begins, as set forth in box 1120, by providing a wire for use in a downhole tool, the wire comprising first strands in a central portion of the wire, the first strands comprising a low thermal expansion material, and providing the wire comprising second strands in a peripheral portion of the wire, the second strands comprising a low electrical resistance material. For example, the wire 700, as shown in FIG. 7, may be used as the wire wrapped around a ceramic mandrel for a coil used in a downhole induction logging tool. Each of the plurality of the strands 510 included in the central portion 500 of the wire 700 may be like the strand 410, as shown in FIG. 4, comprising the low thermal expansion material 420 (with the diameter d) having the low electrical resistance material 430 (with the outer diameter D) disposed on the low thermal expansion material 420. Similarly, each of the plurality of the strands 610 included in the peripheral portion 600 of the wire 700 may be like the strand 210, as shown in FIG. 2, comprising a low electrical resistance material, such as copper (Cu).

As shown in FIG. 11, the method 1100 may proceed by providing an insulating material disposed on each of the first and second strands, as set forth in box 1130. For example, each of the plurality of the strands 510 included in the wire 700 may be like the strand 410, as shown in FIG. 4, further comprising the insulating material 440 (with the outer diameter t) disposed on the low electrical resistance material 430, as described above. Similarly, each of the plurality of the strands 610 included in the peripheral portion 600 of the wire 700 may be like the insulated strand 210, as shown in FIG. 2, comprising a low electrical resistance material, such as copper (Cu), having an insulating material disposed thereon.

Any of the above-disclosed embodiments of a method and a device according to the present invention enables the dimensions (diameter and/or length and/or thickness) of the wire for logging and/or other downhole applications to be more stable when subject to temperature changes. Additionally, many of the above-disclosed embodiments of a method and a device according to the present invention enable the low resistance of the wire for logging and/or other downhole applications to be preserved with appropriate selection of the relative proportions of the low thermal expansion material and the low electrical resistance material. In addition, any of the above-disclosed embodiments of a method and a device according to the present invention enables temperature corrections to be reduced due to the lower radial expansion of coils made from the wire for logging and/or other downhole applications.

The particular embodiments disclosed above, and described with particularity, are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, in the sense of Georg Cantor. Accordingly, the protection sought herein is as set forth in the claims below.

What is claimed:

1. A device comprising:

downhole tool, the downhole tool comprising a wire comprising at least one strand, the at least one strand comprising a low thermal expansion material having a low electrical resistance material disposed thereon, wherein an outer diameter of the wire is D and a diameter of the low thermal expansion material without the low electrical resistance material disposed thereon is d, wherein a ratio of d/D-d is in a range of about 1000:1 to about 2:1; and wherein an insulating material is disposed on the low electrical resistance material.

2. A device comprising:

a downhole tool, the downhole tool comprising a wire comprising at least one strand, the at least one strand comprising a low thermal expansion material having a low electrical resistance material disposed thereon, wherein an outer diameter of the wire is D and a diameter of the low thermal expansion material without the low electrical resistance material disposed thereon is d, wherein a ratio of d/D-d is in a range of about 1000:1 to about 2:1; and wherein the low thermal expansion material has a thermal expansion coefficient lower than the thermal expansion coefficient of copper (Cu).

3. A device comprising:

a downhole tool, the downhole tool comprising a wire comprising at least one strand, the at least one strand comprising a low thermal expansion material having a low electrical resistance material disposed thereon, wherein an outer diameter of the wire is D and a diameter of the low thermal expansion material without the low electrical resistance material disposed thereon is d, wherein a ratio of d/D-d is in a range of about 1000:1 to about 2:1; and wherein the low thermal expansion material comprises a material selected from the group consisting of chromium (Cr), iridium (Ir), molybdenum (Mo), niobium (Nb), osmium (Os), rhodium (Rh), tantalum (Ta), titanium (Ti), tungsten (W), vanadium (V), alloys of preceding members of the group, graphite (C), Invar (a Fe-Ni alloy), and Kovar (a Fe—Ni—Co alloy).

4. A system comprising:

a drill string comprising a downhole tool, the downhole tool having a wire comprising at least one strand, the at least one strand comprising a low thermal expansion material, wherein the low thermal expansion material has a thermal expansion coefficient that is in a range between a value of a thermal expansion coefficient of Invar (a Fe—Ni alloy) and a value of a thermal expansion coefficient of titanium.

5. The system of claim 4, wherein an insulating material is disposed on the low thermal expansion material.

6. The system of claim 4, wherein the low thermal expansion material comprises molybdenum (Mo).

7. The system of claim 4, wherein the low thermal expansion material has a low electrical resistance material disposed thereon, the low electrical resistance material having a thickness in a range from about 0.5 micron to about 100 microns and an electrical resistance lower than the electrical resistance of the low thermal expansion material.

8. The system of claim 7, wherein the low electrical resistance material comprises a material selected from the group consisting of aluminum (Al), copper (Cu), gold (Au), silver (Ag), and alloys of preceding members of the group.

9. A method comprising:

performing a drilling operation using a drill string having a downhole tool comprising a wire comprising at least one strand comprising a low thermal expansion material having a thermal expansion coefficient equal to or lower than a thermal expansion coefficient of copper, wherein the low thermal expansion material bas a low electrical resistance material disposed thereon.

10. The method of claim 9, wherein the thermal expansion material comprises a material selected from the group consisting of chromium (Cr), iridium (Ir), molybdenum (Mo), niobium (Nb), osmium (Os), rhodium (Rh), tantalum (Ta), titanium (Ti), tungsten (W), vanadium (V), alloys of preceding members of the group, graphite (C), Invar (a Fe—Ni alloy), and Kovar (a Fe—Ni—Co alloy).

11. The method of claim 9, wherein the low thermal expansion material comprises molybdenum (Mo).

12. The method of claim 9, wherein the low electrical resistance material has an electrical resistance lower than the electrical resistance of the low thermal expansion material.

13. The method of claim 12, wherein the low electrical resistance material comprises a material selected from the group consisting of aluminum (Al), copper (Cu), gold (Au), silver (Ag), and alloys of preceding members of the group.

14. A method comprising:

performing a drilling operation using a drill string having a downhole tool comprising a wire comprising a plurality of strands, each of the plurality of the strands comprising a low thermal expansion material having a low electrical resistance material disposed thereon, wherein the low thermal expansion material comprises a material selected from the group consisting of chromium (Cr), iridium (Ir), molybdenum (Mo), niobium (Nb), osmium (Os), rhodium (Rh), tantalum (Ta), titanium (Ti), tungsten (W), vanadium (V), alloys of preceding members of the group, graphite (C), Invar (a Fe-Ni alloy), and Kovar (a Fe—Ni—Co alloy).

15. The method of claim 14, wherein an insulating material is disposed on the low electrical resistance material of each of the plurality of the strands.

16. The method of claim 14, wherein the low electrical resistance material has an electrical resistance lower than the electrical resistance of the low thermal expansion material.

17. The method of claim 14, wherein the low thermal expansion material has a thermal expansion coefficient lower than the thermal expansion coefficient of copper (Cu) and the low electrical resistance material has an electrical resistance lower than the electrical resistance of the low thermal expansion material.

18. The method of claim 14, wherein the low thermal expansion material comprises molybdenum (Mo) and the low electrical resistance material comprises copper (Cu).

19. A method comprising:

performing a drilling operation using a drill string having a downhole tool comprising a wire comprising at least one strand comprising a low thermal expansion material having a thermal expansion coefficient lower than the thermal expansion coefficient of titanium.

20. The method of claim 19, wherein an insulating material is disposed on the low thermal expansion material.

21. The method of claim 19, wherein the low thermal expansion material has a low electrical resistance material disposed thereon, the low electrical resistance material having a thickness in a range from about 0.5 micron to about 100 microns and an electrical resistance lower than the electrical resistance of the low thermal expansion material.

22. The method of claim 21, wherein the low thermal expansion material has a thermal expansion coefficient lower than the thermal expansion coefficient of gold (Au) and the low electrical resistance material has an electrical resistance lower than the electrical resistance of the low thermal expansion material.

23. The method of claim 21, wherein the low thermal expansion material comprises molybdenum (Mo) and the low electrical resistance material comprises gold (Au).

* * * * *

UNITED STATES PATENT AND TRADEMARK OFFICE

CERTIFICATE OF CORRECTION

PATENT NO. : 7,866,407 B2
APPLICATION NO. : 11/716998
DATED : January 11, 2011
INVENTOR(S) : Luis E. San Martin et al.

It is certified that error appears in the above-identified patent and that said Letters Patent is hereby corrected as shown below:

In column 8, line 22, in Claim 1, before “downhole” insert -- a --.

In column 9, line 25, in Claim 9, delete “bas” and insert -- has --, therefor.

Signed and Sealed this
Fifth Day of April, 2011

David J. Kappos

David J. Kappos
*Director of the United States Patent and Trademark Office*